US005651736A

United States Patent [19]

Myers

[11] Patent Number: 5,651,736

[45] Date of Patent: Jul. 29, 1997

[54] RACER TOY UTILIZING WATER-DRIVEN BOATS

[76] Inventor: Jeff D. Myers, 7525 N. Shadow Mountain Rd., Paradise Valley, Ariz. 85253

[21] Appl. No.: 582,576

[22] Filed: Jan. 3, 1996

[51] Int. Cl.[6] ..... A63F 9/14

[52] U.S. Cl. ..... 463/64; 463/59

[58] Field of Search ..... 463/58, 64, 59; 273/119 B, 729 AP, 129 R; 446/56, 176, 180, 197, 198, 199, 211, 429

[56] References Cited

U.S. PATENT DOCUMENTS

| | | | |
|---|---|---|---|
| 3,046,694 | 7/1962 | Holderer | 446/180 |
| 3,697,071 | 10/1972 | Anderson | 463/64 |
| 3,936,053 | 2/1976 | Goldfarb et al. | 446/180 |
| 3,950,889 | 4/1976 | Dabneg | 463/64 |
| 4,605,229 | 8/1986 | McKay | 463/64 |
| 4,715,602 | 12/1987 | May et al. | 463/59 |
| 4,963,116 | 10/1990 | Huber | 463/64 |
| 5,032,100 | 7/1991 | Goldfarb | 446/211 |

*Primary Examiner*—William M. Pierce
*Attorney, Agent, or Firm*—Warren F. B. Lindsley

[57] ABSTRACT

A racer toy in which a pair of flat-bottomed boats each having an interior chamber which terminates in an opening at the aft end of the boat are launched onto respective side-by-side tracks from a launching tower having two water passages each extending from a source of water under pressure, such as a garden hose, to a respective nozzle dimensioned to be releasably held in sealing engagement within the aft opening of a respective boat. Each water passage is initially closed by a hand-operated valve which when opened allows pressurized water to flow into the interior chamber of a respective boat and thereby propel it along the track. The tracks are lubricated with water to reduce friction and to cause the boats to hydroplane as they speed along the tracks.

16 Claims, 4 Drawing Sheets

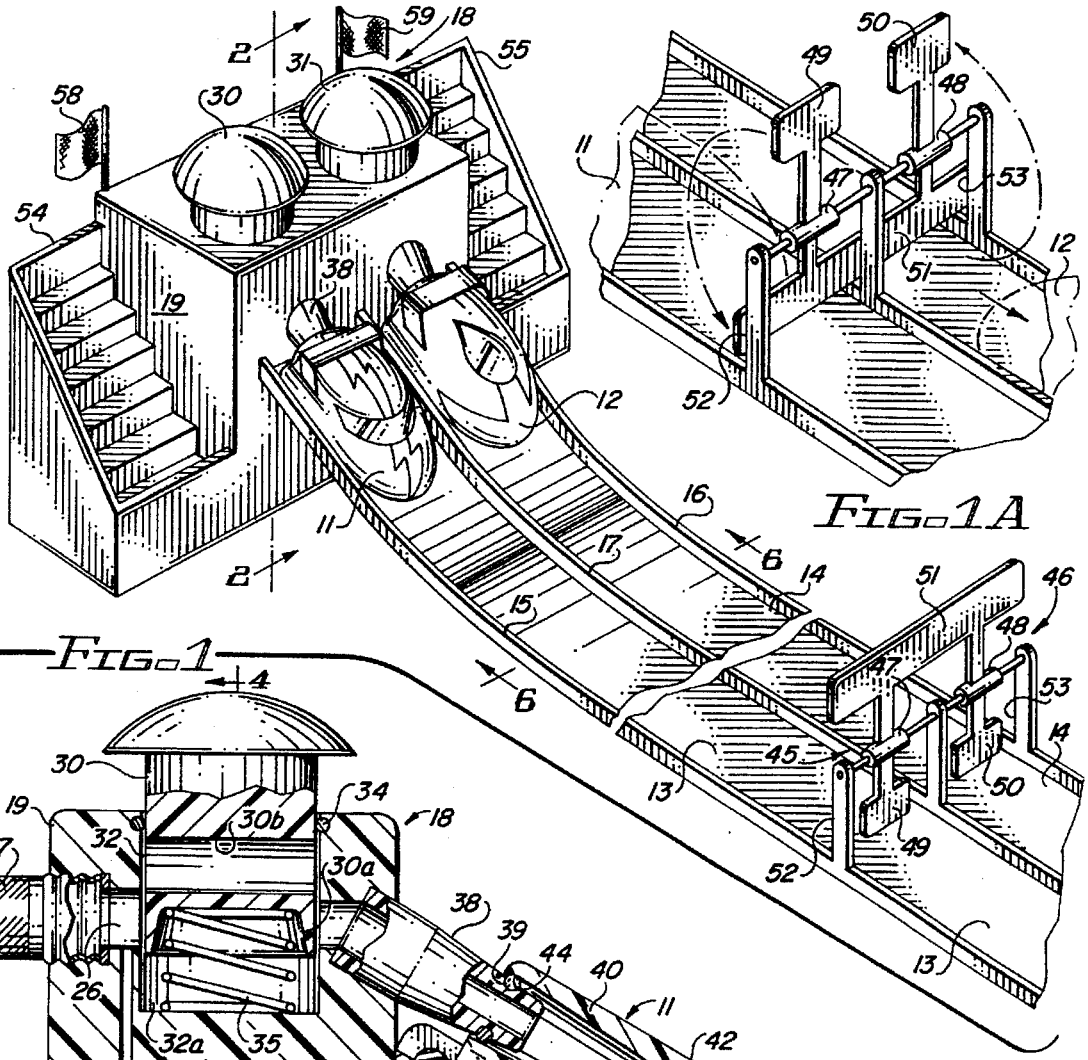
FIG. 1
FIG. 1A
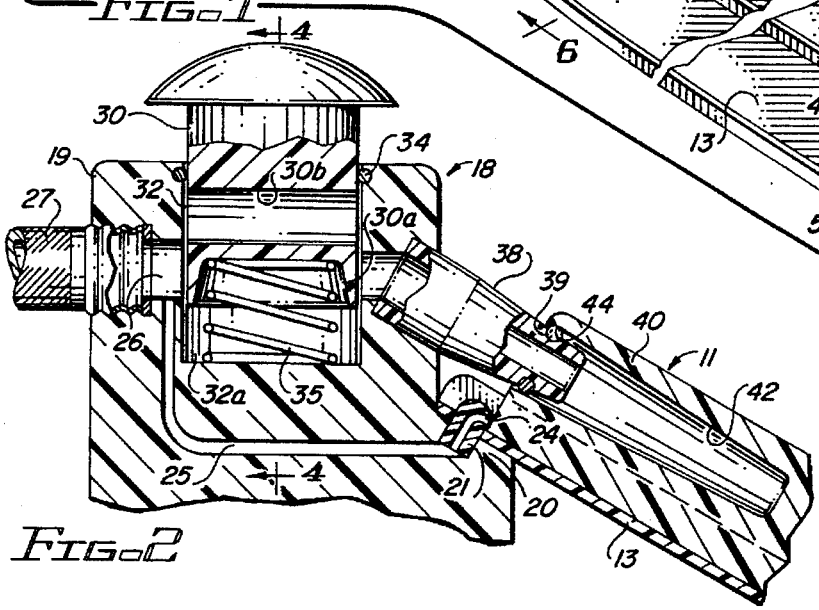
FIG. 2
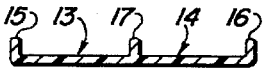
FIG. 6
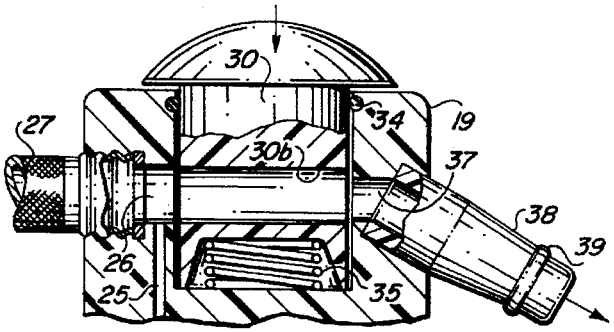
FIG. 3
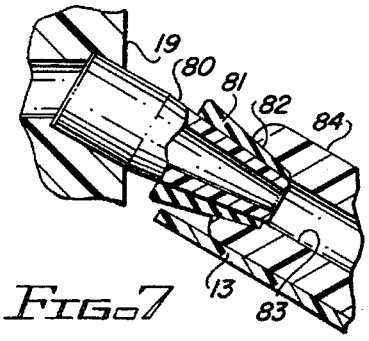
FIG. 7

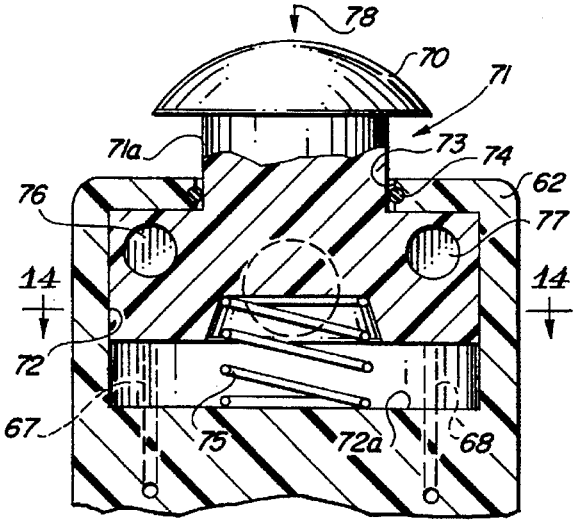
FIG. 13
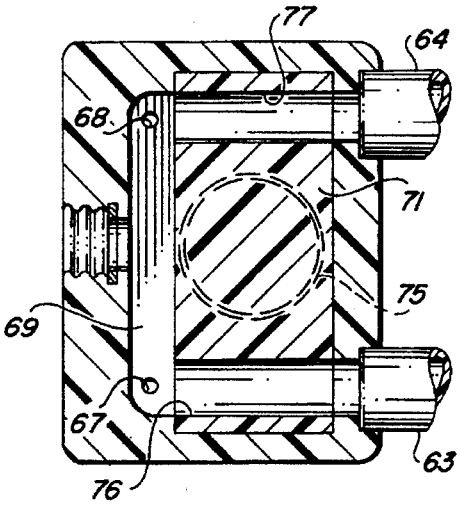
FIG. 14
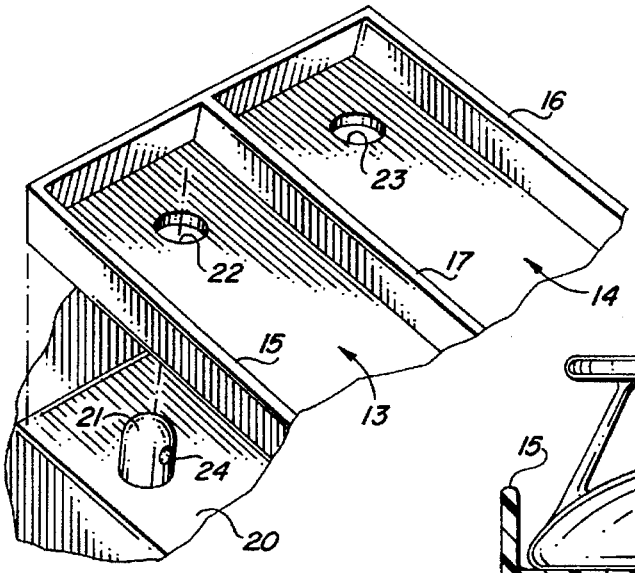
FIG. 8
FIG. 10
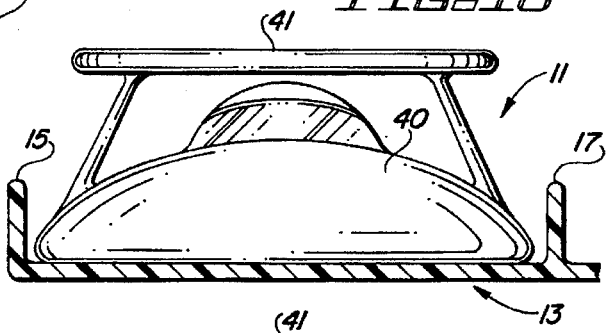
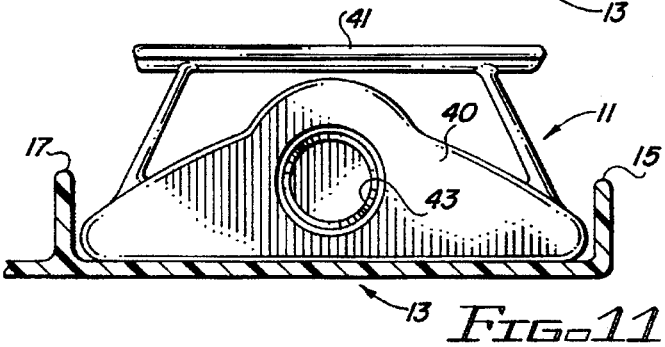
FIG. 11
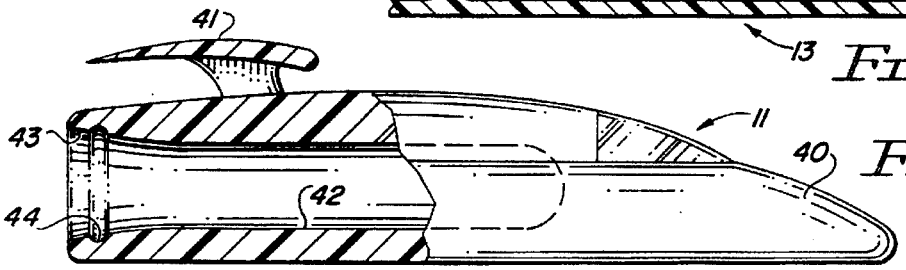
FIG. 9

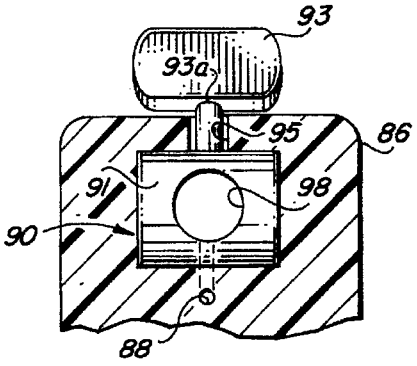
FIG. 17
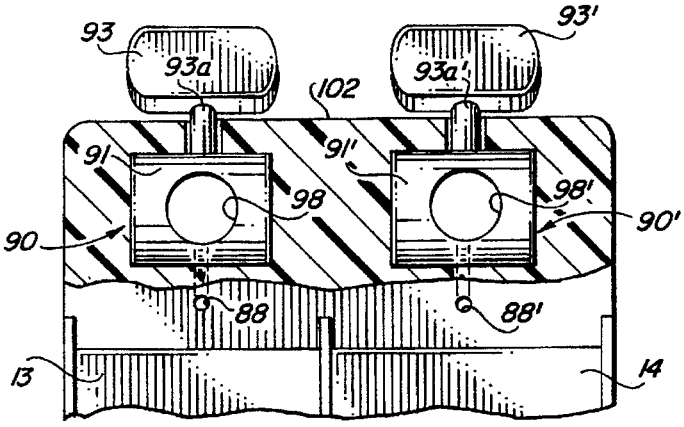
FIG. 18
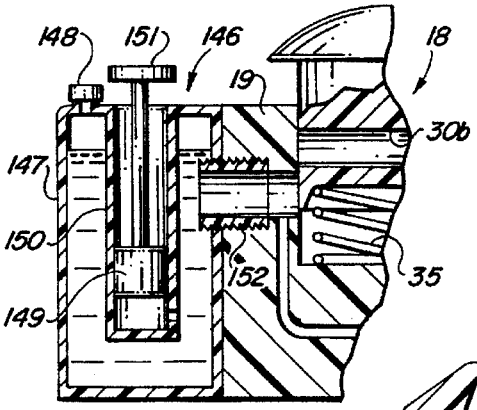
FIG. 22
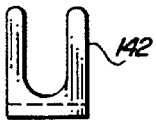
FIG. 21A
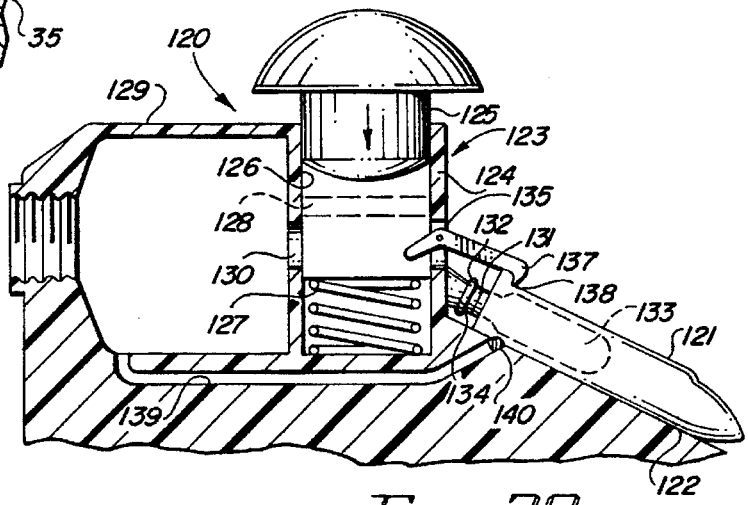
FIG. 20
FIG. 21
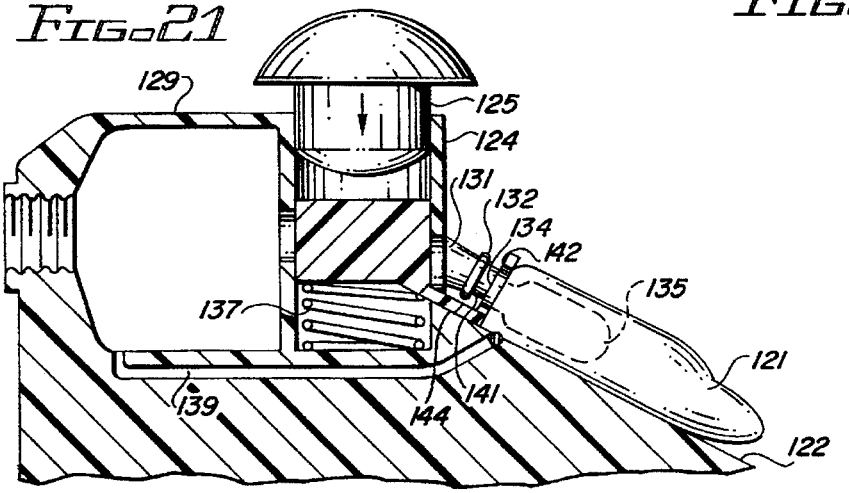

RACER TOY UTILIZING WATER-DRIVEN BOATS

BACKGROUND OF THE INVENTION

This invention relates to amusement devices for children and, more particularly, to a racer toy in which the racing vehicles are boats and water pressure is used to propel them along a track lubricated with water.

DESCRIPTION OF THE PRIOR ART

The prior art is replete with examples of toys in which a vehicle, such as a wheeled car, is propelled along a guiding track by a self-contained electric motor, for example, in competition with a like vehicle propelled along an adjacent track. A race is started by separately releasing each vehicle from a start position, and thereafter its speed may or may not be controlled depending upon the motive power used to drive the vehicles. Of the forms of toy racing vehicles known to applicant, none are boats nor are any driven by water pressure. Thus, there is a need for an action toy in which competing boats are driven by water pressure along respective tracks.

SUMMARY OF THE INVENTION

Briefly, the toy in accordance with the invention includes a pair of flat-bottomed boats each having an interior cavity which terminates in a cylindrical opening at the aft end of the boat. Each boat is launched onto a respective track, the starting end of which is attached to a launching tower having two passages for water, each extending from a source of water under pressure, such as a garden hose, to a nozzle disposed above the starting end of a respective track, the nozzle being dimensioned and arranged to be received and releasably held in water-tight engagement within the aft opening of a respective boat. Each water passage is initially closed by a respective hand-operated valve which when opened releases the boat and allows pressurized water to flow through the nozzle into the interior cavity of a respective boat and thereby propel it along the track. Friction between the boat and track is reduced by lubricating the track with water so as to cause the boat to hydroplane. The valve may be a vertically-oriented plunger, normally spring-biased upwardly to a closed position, which when rapidly depressed against the action of the spring opens the water passage and initiates launch of the boat.

Accordingly, it is an object of this invention to provide a new and improved action toy.

Another object of the invention is to provide a tracked racing toy wherein the racing vehicles are boats which are propelled along respective tracks by pressurized water.

Still another object is to provide a new and improved racing toy which can be readily manufactured at relatively low cost.

BRIEF DESCRIPTION OF THE DRAWINGS

Other objects, features and advantages of the invention will become apparent, and its construction and operation better understood, from the following detailed description when read in conjunction with the accompanying drawings, in which:

FIG. 1 is a perspective view of the preferred embodiment of a boat racing toy constructed according to the invention;

FIG. 1A is an enlarged perspective view of the winner's gate shown in FIG. 1:

FIG. 2 is a fragmentary sectional view taken along line 2—2 of FIG. 1, showing the toy's launching mechanism in readiness to launch a boat;

FIG. 3 is a fragmentary elevation sectional view of FIG. 1 showing the position of the launching mechanism immediately following launch of a boat;

FIG. 6 is a sectional view taken along line 6—6 of FIG. 1;

FIG. 7 is a fragmentary sectional view of an alternative launching nozzle;

FIG. 8 is an exploded perspective view showing how the track is attached to the launching mechanism;

FIG. 9 is a partially sectioned side view of a racing boat;

FIG. 10 is a front view of FIG. 9;

FIG. 11 is a rear view of FIG. 9;

FIG. 13 is a sectional elevation view taken along line 13—13 of FIG. 12;

FIG. 14 is a sectional plan view taken along line 14—14 of FIG. 13;

FIG. 17 is a fragmentary sectional elevation view taken along line 17—17 of FIG. 16;

FIG. 18 is a partially sectioned elevation view of an alternative launching mechanism for the embodiment of the toy shown in FIG. 1;

FIG. 20 is an elevation view, partially in section, showing an alternative form of launching tower and release mechanism;

FIG. 21 is an elevation view, partially in section, showing yet another form of release mechanism;

FIG. 21A is an elevation view of a part of the release mechanism shown in FIG. 21; and FIG. 22 is a sectional elevation view showing a pump for controlling the pressure of water supplied to the launching mechanism.

DESCRIPTION OF THE PREFERRED EMBODIMENTS

Figure 12:
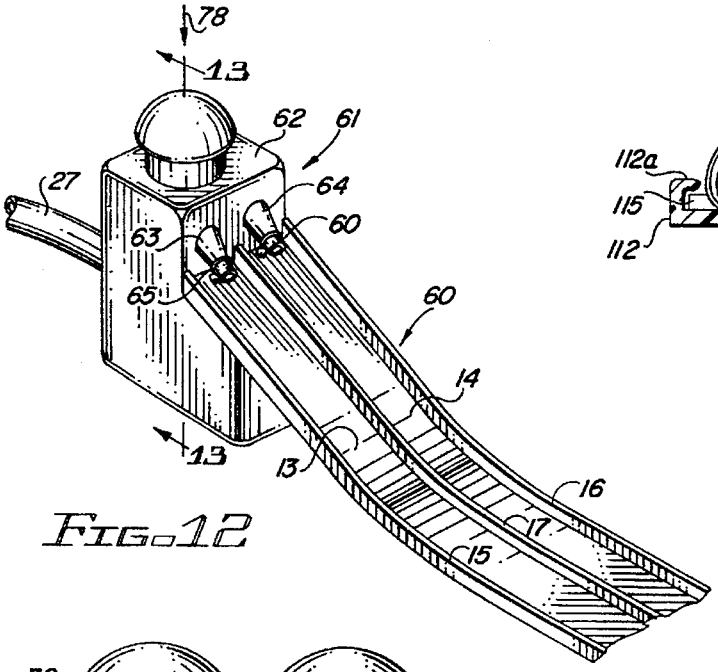
FIG. 12 is a fragmentary perspective view of an alternative embodiment of the toy.

Referring to the drawings, the racer toy according to the invention, the preferred embodiment of which is shown in FIG. 1 in readiness for the start of a race, includes a pair of boats 11 and 12 supported at the launch end of side-by-side elongate tracks 13 and 14, respectively. As seen in FIG. 6, each of tracks 13 and 14 has a flat bottom, outer sidewalls 15 and 16, respectively, and a common sidewall 17 disposed equidistant from and parallel to the sidewalls. Alternatively, two separate side-by-side tracks each with parallel sidewalls may be used. The tracks may be of the type used in currently available car racer toys, typically extruded from flexible plastics material; available tracks typically are 1-½inches wide and have sidewalls ¼-inch high. In the present application the tracks are on the order of ten to twelve feet long, preferably composed of interlocking short sections (not shown) for convenience in handling and packaging.

As best seen in FIGS. 2 and 8, a downwardly sloping launch end portion of each of tracks 13 and 14 is removably attached to the front face of a launching tower 18 consisting of a body member 19 in the general shape of a parallelepiped and having a horizontally oriented ledge 20 on its front surface which slopes downwardly at substantially the same slope as tracks 13 and 14. The tracks are supported and held in place on the ledge 20 by cylindrical protuberances projecting perpendicularly therefrom, one of which is seen at 21 in FIGS. 2 and 8, which extend through openings 22 and 23 in the bottom wall of the tracks 13 and 14, respectively.

When the toy is in use, the tracks are lubricated with water discharged through an orifice in each protuberance, one of which is visible at 24 in FIGS. 2 and 8, the water being supplied through a conduit 25 molded into body number 19 and providing fluid communication between a water chamber 26 and the orifice 24 in protuberance 21. Water under pressure is supplied to chamber 26 through a conventional garden hose 27 connected at one end to body member 19 and at the other end to a domestic water supply, which typically has a pressure in the range from about 50 psi to about 75 psi, and may be as high as 150 psi. Since conduit 25 is not valved, water is continuously supplied and laid down in a thin sheet on the tracks whenever and so long as the hose is turned on.

Figure 4:
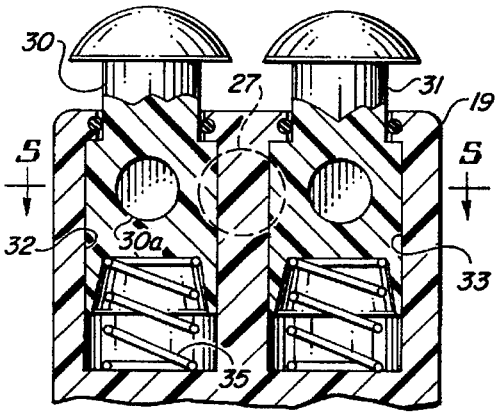
FIG. 4 is a sectional view taken along line 4—4 of FIG. 2.
Figure 5:
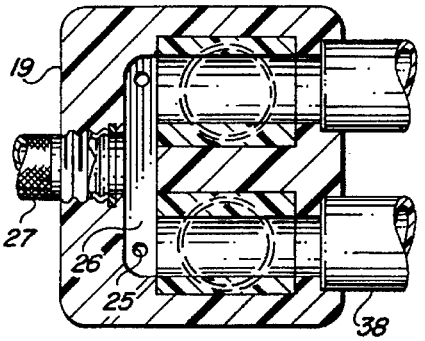
FIG. 5 is a sectional view taken along line 5—5 of FIG. 4.

The racing boats 11 and 12 are individually launched by striking the generally hemispherical top surface of a respective vertically-oriented cylindrical plunger 30 and 31, each of which is arranged for limited up and down movement within a respective cylindrical bore 32 and 33 disposed side-by-side within body member 19, as seen in FIG. 4. The construction of the two plungers being the same, only plunger 30 and its associated structure, shown in FIG. 2 and 3, will be described. The diameter of the bore is slightly larger than that of the plunger 30 and extends downwardly from the top surface of body member 19 to a flat bottom **32*a* and an O-ring 34** supported near its upper end provides a water-tight seal between it and the plunger as the latter moves up and down.

Plunger 30 is normally urged to the uppermost position shown in FIG. 2 by a compression spring 35, one end of which is supported on the bottom surface **32*a* of the bore and the other end of which engages a cylindrical cavity 30*a* formed in the lower end of plunger 30. In this position there is a space between the lower edge of the rounded head and the upper surface of body member 19, and also, importantly, a horizontally-oriented bore 30*b* extending diametrically through the plunger is positioned out of register with, and thus prevents the flow of water from, water chamber 26 (beyond that carried by conduit 25). When plunger 30 is depressed, as indicated by the arrow, against the bias of spring 35 to the position shown in FIG. 3, diametral bore 30*b* is aligned with water chamber 26, and also with a passageway 37 in fluid communication with the inner bore of a tapered nozzle 38; the bore 30*b* thereby completes a water passage from chamber 26 to and through nozzle 38. Thus, plunger 30 functions as a normally closed valve which when a user strikes its upper end to move it to a second position is opened and allows water to flow from a water source through a nozzle from which a boat is launched. The relative vertical distance between the underside of the plunger head, the diametral bore 30*b* and horizontally aligned water chamber 26 and passageway 37, insure that the valve is open when the underside of the plunger head engages the upper surface of body member 19** and arrests further downward movement. Upon removal of downward force on the plunger, normally expected to happen immediately after the boats are launched, the valve is quickly and automatically closed so as to limit use of water only to that needed for track lubrication and driving the boats.

The racing boats 11 and 12 according to the invention, of which boat 11 is shown in FIGS. 9, 10 and 11, each has an elongate, low-profile flat-bottomed hull 40 having a width which approximates but is slightly less than the transverse spacing between track sidewalls 15 and 17 and preferably is molded from a high-impact plastics material. The tendency of the boat to hydroplane on the sheet of water covering the track is counteracted by an integral transverse air-foil or "spoiler" 41 located above and near the aft end of the hull. As will later be more fully explained, the boat is launched and propelled along the track by injecting water into an elongate cylindical interior cavity 42 or pressure chamber disposed along the longitudinal axis of hull 40 and terminating in a circular opening 43 at the aft end dimensioned to receive the nozzle 38.

Reverting to FIGS. 2 and 3, boat 11 is readied for launch by placing it on track 13 with its aft end facing the launching tower 18 and, after inserting nozzle 38 into the circular opening 43, urging the boat toward the tower until a peripheral groove 44 near the aft end of interior cavity 42 engages an O-ring 39 fitted in a groove near the exit end of nozzle 38. Peripheral groove 44 and O-ring 39 provide a water-tight seal between the nozzle and the interior cavity of the boat and serve the additional function of releasably locking the boat to the launching tower.

In use of the toy in a racing mode, with water hose 27 turned on so as to lubricate tracks 13 and 14 via conduits 25, each of two contestants affixes a boat 11 or 12 to a respective launching nozzle, as depicted in FIG. 1, and when given a "start" signal, preferably from a third person, each tries to be the first to strike a respective actuating plunger 30 or 31. Upon depression of a plunger to the position shown in FIG. 3, water at substantially hose pressure flows from chamber 26 through the water passage defined by bore **30*b* and opening 37 and is discharged from nozzle 38 and quickly fills cavity 42 of a respective boat to a pressure sufficient to release groove 44 from O-ring 39 on the nozzle, whereupon the boat is fired toward the finish end of the track. If it is assumed that the thickness of the sheet of water is the same on both tracks and that other track conditions do not alter the otherwise substantially equal boat-to-track friction, the first boat to be launched should win. While it can easily be seen which of the two boats first crosses the finish line, any doubt in the case of a close finish may be resolved, and the play value of the toy enhanced, by "victory gates" associated with each track which are mechanically interlocked such that once the winner's boat passes the finish line the other cannot pass. More specifically, the gate mechanism includes three vertically oriented support members extending upwardly from the track sidewalls, two of which are identified by numerals 52 and 53, on which gate assemblies 45 and 46 are supported on pin-and-collar joints 47 and 48, respectively, for rotation about a horizontal axis. As seen in FIG. 1, gate assemblies 45 and 46 each include an arm secured at one end to and extending downwardly from a respective pin-and-collar joint 47 and 48 and having rectangular plates 49 and 50 secured to the distal end, the lower edge of each of which is vertically spaced from the bottom surface of a respective track a distance so as to be struck by a racer boat. As depicted in FIG. 1A, the impact of the first-to-arrive boat 12 on plate 50 rotates both gate assemblies about the horizontal axis of the pin-and-collar joints 47 and 48 and bring a common panel 51 supported on arms extending upward from pin-and-collar joints 47 and 48, and heavier than the combined weight of plates 49 and 50, down into a rest position against support members 52 and 53, but not before the winning boat 12 has passed through the gate, and stops the trailing boat 11**.

While not necessary to the operation of the launching tower, grandstands 54 and 55 may be provided on either side of the launching tower 18 to enhance the mechanical stability of the tower and also the play value of the toy. The grandstands may be integrally molded with launching tower 18, or may be fabricated as a single hollow plastic molding have relatively thin walls and defining a cavity dimensioned to receive and firmly engage the side and back walls of body member 19. The grandstands may have a color different from that of the tower, and preferably has a multiplicity of ascending seats or platforms simulative of a real-life grandstand or stadium. A pair of flags 58 and 59 supported on the launching add to the realism.

An alternative construction 60 of the toy intended for individual use, shown in FIGS. 12, 13 and 14, includes a pair of boats which are simultaneously launched onto respective water-lubricated tracks upon operation of a single actuating device, whereby the winner is determined only by the conditions of the tracks, not by the quickness or dexterity of the user. In common with the preferred embodiment, a pair of boats (not shown) are launched from a launching tower 61 and waterdriven along respective side-by-side tracks 13 and 14, each attached at one end to the front surface of launching tower 61 in the manner illustrated in FIGS. 2 and 8. Launching tower 61 consists of a body member 62 similar in shape to body member 19 and has a pair of nozzles 63 and 64 sloping downwardly from the front surface in alignment with, and generally parallel to tracks 13 and 14. The nozzles may have the same construction as nozzle 38, including O-rings 65 and 66 for releasably engaging a peripheral groove 44 in a respective racing boat 40.

A sheet of water is laid down on each track by water supplied through respective conduits 67 and 68 molded into body member 62 which carry water from a water chamber 68 to an orifice in a protuberance corresponding to protuberance 21 in FIG. 8. Water under pressure is supplied to chamber 69 through a conventional garden hose 27 connected at one end to body member 62 and at the other end to a domestic water supply.

Racing boats 11 and 12 may be launched simultaneously, or either may be launched one at a time, by striking the generally hemispherically-shaped top surface 70 of a vertically-oriented cylindrical plunger 71 supported for limited up and down movement within a cylindrical bore 72 formed in body member 62. An upper portion 71*a*, of smaller diameter than the lower portion of the plunger, extends in sealing relationship through a circular opening 73 centrally located in the top surface of body member 62 and surrounded by an O-ring 74. Plunger 71 is normally urged to the uppermost portion shown in FIG. 12 by a compression spring 75, one end of which is supported on the bottom surface 72*a* of the bore and the other end of which engages a cavity centrally formed in the lower face of the plunger. Upward motion of the plunger is limited by the shoulder of the larger diameter lower plunger portion engaging the underside of the portion of body member 62 that surrounds plunger portion 71*a*. In this position, the vertical distance between the lower edge of rounded head 70 and the top surface of body member 62 equals the vertical distance from the lower end of plunger portion 71*b* and the bottom 72*a* of bore 72, and also, two parallel horizontally-oriented cylindrical openings 76 and 77 extending through the lower plunger portion are positioned out-of-register with water chamber 69 so as to preclude water flow from the chamber.

When plunger 71 is depressed, as indicated by arrow 78, against the bias of spring 75, until the bottom surface of the lower plunger portion engages the bottom 72*a* of bore 72, cylindrical openings 76 and 77 are aligned with water chamber 69 and with nozzles 63 and 64, respectively, to complete two passages for water to flow to nozzles 63 and 64. Thus, plunger 71 is, in effect, a normally closed valve which when depressed by a user is opened to allow water under pressure to flow to and through nozzles 63 and 64 and launch a single boat affixed to one of the nozzles, or simultaneously launch two boats, one affixed to each nozzle. It will be appreciated that a consequence of launching an individual boat will be the discharge of water from the unused nozzle for so long as the valve is open; however, as the toy is intended for outdoor use, this will only add to its enjoyment and play value.

An alternative to the described O-ring/groove arrangement for releasably attaching a boat to the launching tower, shown in FIG. 7, includes a nozzle 80 having a tapered end surrounded by a correspondingly tapered hollow tip 81 formed of rubber, or other suitable compressible material, dimensioned to be received with a frictional water-tight fit in a similarly tapered cylindrical opening 82 formed at the aft end of the interior cavity 83 of a racing boat 84. Preparatory to launch, the rubber-tipped nozzle is inserted into the tapered opening in the boat, and the boat urged toward the launching tower to compress the rubber sufficiently to maintain connection between boat and nozzle until initiation of launch, yet not so tight as to unnecessarily delay release of the boat following turn-on of the water. With experience, the user will be able to optimize the connecting force to an amount which will provide hair-trigger release of the boat upon actuation of the valve, an important skill factor should the arrangement of FIG. 7 be incorporated in the competitive embodiment of the toy shown in FIG. 1.

Figure 15:
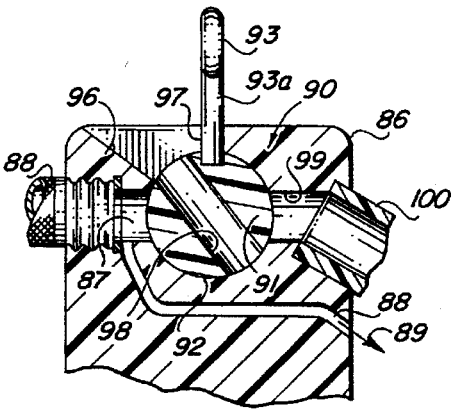
FIG. 15 is a fragmentary sectional elevation view of an alternative launching mechanism, in readiness for launch.
Figure 16:
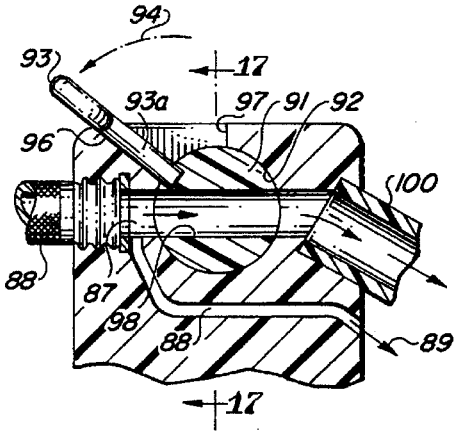
FIG. 16 is a fragmentary sectional elevation view showing the launching mechanism of FIG. 15 following launch.

An alternative shown in FIGS. 15–17 to the described plunger-activated valve, includes a body member 86 having an integral water chamber 87 to which water under pressure is supplied through a conventional garden hose 88 connected to a domestic water supply. Track-lubricating water flows from chamber 87 through a small-diameter conduit 88 molded in body member 86, as indicated by arrow 89, even when the actuating valve 90 is in the closed position shown in FIG. 15. As best seen in FIG. 17, valve 90 consists of a short horizontally-oriented cylindrical member 91, preferably molded from a high-impact plastic, supported within a cylindrical cavity 92 of substantially the same diameter for limited angular movement about its longitudinal axis. Application of force to a handle 93 attached at a point on the periphery at mid-length causes the cylindrical member to rotate from the closed position shown in FIG. 15 through the angle of about 60°, represented by arrow 94, to the open position shown in FIG. 16. The stem 93*a* of the handle passes through an arcuate slot 95 (FIG. 17) having opposite end walls 96 and 97, respectively, which determine the limits of the angle through which the handle can be moved.

With handle 93 in the closed position (FIG. 15), a circular cylindrical opening 98 extending diametrically through cylindrical member 90 at mid-length is so oriented that both of its ends abut the wall of cavity 92 and thereby precludes water flow from chamber 87 (other than that through conduit 88). However, movement of handle 93 to the position shown in FIG. 16, which in the heat of competition would be done with a quick jerk, aligns opening 98 with water chamber 87, and also with a circular cylindrical passageway 99, and completes a passage for water to flow from chamber 87 to and through a nozzle 100, as indicated by the arrow, to effect launch of a boat releasably coupled to the nozzle.

The pair of such valves shown in FIG. 18, wherein corresponding parts of the valves at the left and right are respectively identified with the numerals used in FIGS. 15–17 and the primes of these numbers, may be used in the FIG. 1 embodiment in place of plungers 30 and 31. Cylindrical members 90 and 90' are supported within respective cylindrical cavities 92 and 92' formed in a common body member 102 and so spaced that their cylindrical openings 98 and 98' are respectively centered over tracks 13 and 14.

Figure 19:
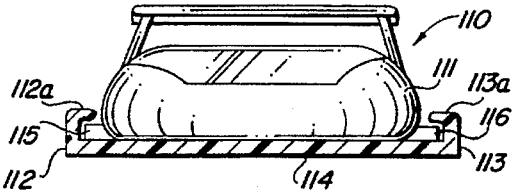
FIG. 19 is an elevation view showing an alternative construction of the boat and track.

An alternative construction of boat and track schematically illustrated in FIG. 19 includes a boat 110 having an elongate, low-profile flat-bottomed hull 111 having a width to move freely between the sidewalls 112 and 113 of a track 114. The tendency of a hydroplaning boat to leave the track is reduced by cooperation between the turned-in upper edges 112*a* and 113*a* of the track's sidewalls and a pair of flanges 115 and 116 which extend laterally from opposite sides of the boat substantially coplanarly with the flat bottom of hull 111. The width of the flanged bottom of the hull approximates but is slightly less than the spacing between sidewalls 112 and 113, and the flange thickness is sufficiently less than the height of the turned-in upper edges of track 114, to allow the boat to move freely along the track and at the same time prevent the boat from jumping the track. However, the cost of this feature may be some reduction in speed due to increased friction between the boat flanges 115 and 116 and the sides and turned-in upper edges of sidewalls 112 and 113 as it hurtles along the track.

Referring now to FIG. 20, another embodiment of the racer toy 120 according to the invention, schematically shown in readiness for launch, includes a pair of boats (only one of which is shown at 121) supported at the launch end of side-by-side tracks, one of which is visible at 122, having a construction similar to that shown in FIG. 1. The tracks are attached to the front face of a launching tower 123 comprising a body member 124 in which a pair of vertically-oriented cylindrical plungers, one of which appears at 125, are arranged for limited up and down movement within respective cylindrical bores, one of which is seen at 126. The plungers being of like construction only plunger 125 and its associated structure will be described.

Plunger 125 is normally urged to its illustrated uppermost position by a compression spring 127 disposed between the lower end of the plunger and the bottom of bore 126. In this position, a horizontal cylindrical bore 128 extending diametrically through plunger 125 is out-of-register with, and thus prevents flow of water from, a water pressure tank 129 which, in turn, is connected by a garden hose to a domestic water supply. Depression of plunger 125 against the bias of spring 127 to a position where the underside of the plunger's head engages body number 124, aligns bore 128 with an opening in that wall of water tank 129 which faces plunger 125 so as allow water under pressure to flow through bore 128 to and through a nozzle 131. The nozzle slopes downwardly from the front surface of the launching tower and is constructed to mate with a circular opening at the aft end of boat 121 and direct water under pressure into a pressure tank 133 within the boat.

Preparatory to launch, an annular gasket 134 is placed between the aft end of boat 121 and collar 132 on the nozzle and the boat urged toward the launch tower so as to compress gasket 134 to form a water-tight seal between the nozzle and interior pressure tank 133. This connection is maintained with a linkage mechanism 135 having a release arm provided with a hook 137 which releasably engages a tab 138 extending upwardly from the aft top end of boat 121. Release mechanism 135 is operably coupled to plunger 125 such that depression of plunger 125 moves the release arm upwardly thereby to disengage hook 137 from tab 138 at substantially the same time that water starts to flow through nozzle 131 and into the boat's interior water chamber, whereupon the boat is fired down the track lubricated with water carried from tank 129 through a conduit 139 to a nozzle 140 disposed above track 122. Compression spring 127 returns the plunger to its uppermost position to close the valve and, at the same time, re-sets the linkage mechanism 135 for receiving another boat.

The significant volume of water contained in pressure tank 129, which may be on the order of a quart, provides a more uniform pressure on a closed plunger 125 as compared to when the hose is directly connected to the launching tower, thus insuring that the starting conditions will be substantially the same for successive launches of one or both boats. Upon actuation of plunger 125, water at the stabilized tank pressure transferred via nozzle 131 to the smaller pressure tank 133 within the boat maximizes the driving thrust applied to the boat.

FIG. 21 shows a modification of the FIG. 20 embodiment, the difference residing primarily in the mechanism employed for releasably maintaining a water-tight connection, preparatory to launch, between an interior pressure tank 135 in the boat 121 and a nozzle 131 having a collar 132 near its open end. More specifically, an annular gasket 134 is placed between a nipple 141 at the aft end of the boat and the nozzle collar 132 and the boat urged toward the launch tower sufficiently to compress the gasket and allow a U-shaped fork arm 142, shown in elevation in FIG. 21A, to slip into and engage a groove in the outer periphery of the nipple. The fork is operably coupled to the bottom end of plunger 125 by an integral arm 144 such that depression of the plunger to the position at which the valve is open moves arm 144 downwardly to disengage fork arm 142 from the groove in the nipple, thereby to release the boat at substantially the same time that water starts to flow through the nozzle to fire the boat down the track.

In lieu of the pressure tank 129 in the embodiments shown in FIGS. 20 and 21, or the small chamber connected to a hose in the FIG. 2 embodiment, the source of water under pressure may be a hand-operated pump 146 coupled to the water inlet side of the launching tower as shown in FIG. 22. Pump 146 may be of the kind conventionally used in garden sprayers, for example, consisting of a cylindrical tank 147 which is partially filled with water through a capped opening 148. The contained water is pressurized by pumping a piston 149 up and down within internal cylinder 150 with a handle 151. The pump may be used with any of the above-described launching towers and in FIG. 22 is shown threadably attached with a simple pipe nipple 151 to a launching tower 18 having the construction shown in FIG. 2. The tank 147 is pumped to a desired pressure, in the 50 to 150 psi range, preparatory to launch and, provided the plunger 30 is released promptly following each launch, may be capable of powering several launches before it needs to be re-pumped. The pump not only enables the user to control the pressure of the water, and thus the launching velocity, but also permits the toy to be used at locations not conveniently reachable by a hose or at which the water pressure is low.

It will now be evident to ones skilled in the art that certain modifications and changes, in addition to the alternatives already mentioned, may be made in the described racing toy without departing from the spirit and scope of the invention. For example, while continuous lubrication of the tracks is preferred, it is within the contemplation of the invention to make an initial launch onto dry tracks and depend on spillage from the launching nozzles to provide lubrication for subsequent launches. Also in a low-end version of the toy the launching tower may have only one water-lubricated track and a single valve for controlling the launch onto the track of a single racing boat. It is intended that all matter contained in the above description or shown in the accompanying drawings shall be interpreted as illustrative and not in a limiting sense.

What is claimed is:

1. A water-driven action toy comprising:

first and second boats each having a substantially flat-bottomed hull having an interior chamber open at an aft end, and means for launching said boats each onto a launch end of a respective track, said means for launching comprising a body member defining first and second passageways each having an inlet and connectable to a source of water under pressure and an outlet end adapted to mate with the open aft end of the interior chamber of a respective boat, first and second elongate tracks each having a launch end supported side-by-side on said body member below the outlet end of said passageway on which a respective boat is supported, preparatory to launch, with the open aft end of the interior chamber of the boat in releasable sealing relationship with the outlet end of a respective passageway of said boat, conduit means in said body portion for carrying water from a source of water to the launch end of each track for lubricating the same, and first and second valve means disposed between the inlet and outlet ends of said first and second passageways, respectively, each including means for actuating the valve means from a first normally closed position to a second position at which the respective passageway is open and when open allows water under pressure to flow from a source into the interior chamber of a respective boat and drive said boat along its respective track toward a finish end.

2. The action toy of claim 1, wherein said first and second valve means include means for independently actuating said first and second valve means between their respective first and second positions whereby the order in which said first and second valve means are actuated to said second position determines the order in which said first and second boats are launched along a respective track.

3. The action toy of claim 2, wherein said toy further comprises a winner's gate at the finish end of each track each including a means for signalling which of said first and second boats first reaches said winner's gate.

4. The action toy of claim 1, wherein said first and second valve means include means for actuating both valves to said second position in unison for launching said first and second boats substantially simultaneously.

5. The action toy of claim wherein said first and second passageways are disposed substantially horizontally and parallel to each other, and wherein the valve means in each passageway comprises a vertically oriented cylindrical bore intersecting a respective passageway and a cylindrical plunger supported within said cylindrical bore for up and down movement between first and second positions, each said plunger having a transverse opening which aligns with a respective passageway when the plunger is in said second position.

6. The action toy of claim 5, wherein said first and second valve means include means for independently actuating their respective cylindrical plungers between their respective first and second positions whereby the order in which said first and second boats are launched along a respective track is determined by which of said first and second plungers is first moved to its said second position.

7. The action toy of claim 5, wherein said first and second valve means include means interconnecting their cylindrical plungers so as to be actuable in unison between their first and second positions whereby to launch said first and second boats substantially simultaneously responsively to simultaneous actuation of the interconnected plungers to their second positions.

8. The action toy of 5, wherein each of said cylindrical plungers projects from an upper surface of said body member and terminates at an upper end in a rounded head adapted to be struck by a user for quickly moving the plunger to said second position.

9. The action toy of claim 8, wherein each of said cylindrical plungers is spring-biased upward toward its first position.

10. The action toy of claim 5, wherein the outlet end of each passageway comprises a nozzle, and wherein each nozzle is maintained in sealing relationship with the interior chamber of a respective boat with a linkage mechanism coupled to a plunger, wherein said linkage mechanism includes a release arm which releasably engages said boat preparatory to launch and responsively to movement of said plunger to said second position is disengaged and allows the boat to be released from said nozzle by water under pressure flowing from a source into the interior chamber of the boat.

11. The action toy of claim 1 wherein said source of water under pressure is a domestic water supply connectable by a hose to the inlet end of said first and second passageways.

12. The action toy of claim 1, wherein said source of water under pressure comprises a pressure tank filled with water from a domestic water supply and connected in fluid communication with the inlet end of said first and second passageways.

13. The action toy of claim 1, wherein said source of water under pressure is a pump including a tank fillable with water in fluid communication with the inlet end of said first and second passageways and a piston adapted for reciprocable motion within a cylinder disposed within said tank for varying the pressure of water transferred from said tank to said inlet end of said passageway.

14. The action toy of claim 1, wherein said first and second passageways are disposed substantially horizontally and parallel to each other, and wherein each valve means comprises a horizontally-oriented cylindrical bore in said body member intersecting a respective passageway and an elongate cylindrical member supported within said cylindrical bore for angular movement about a long axis between first and second positions, said cylindrical member having a transverse opening which aligns with said passageway only when said cylindrical member is in said second position, and a handle affixed thereto for moving said cylindrical member angularly between said first and second positions.

15. The action toy of claim 1, wherein each boat has flanges of predetermined thickness which extend laterally from opposite sides of the boat substantially coplanarly with the flat bottom of its hull to provide a flanged flat hull bottom of predetermined width, and wherein each track has a bottom surface having a width which approximates but is slightly greater than said predetermined width of the flanged flat bottom of said hull and has parallel vertical sidewalls which are higher than the predetermined thickness of said flanges each turned inwardly along an upper edge for engaging a respective flange on said hull for reducing the tendency for a fast-moving boat to leave said track.

16. The action toy of claim 1, wherein the outlet end of each passageway comprises a tapered nozzle having an open end and wherein an O-ring is supported near said open end of each nozzle engages a peripheral groove at the open end of the interior chamber of a respective boat for releasably joining said nozzle to a respective boat, preparatory to launch, and adapted to be released by water under pressure flowing from a source into the interior chamber of the boat.

* * * * *

UNITED STATES PATENT AND TRADEMARK OFFICE

CERTIFICATE OF CORRECTION

PATENT NO. : 5,651,736

DATED : July 29, 1997

INVENTOR(S) : Jeff D. Myers

It is certified that error appears in the above–identified patent and that said Letters Patent is hereby corrected as shown below:

Claim 5, line 1, after "claim", insert ---1---.

Signed and Sealed this

Ninth Day of December, 1997

*Attest:*

*Attesting Officer*

BRUCE LEHMAN

*Commissioner of Patents and Trademarks*